US010978235B2

(12) United States Patent
Jeong et al.

(10) Patent No.: US 10,978,235 B2
(45) Date of Patent: Apr. 13, 2021

(54) INDUCTOR

(71) Applicant: SAMSUNG ELECTRO-MECHANICS CO., LTD., Suwon-si (KR)

(72) Inventors: Jong Suk Jeong, Suwon-si (KR); Han Wool Ryu, Suwon-si (KR); Seong Jae Lee, Suwon-si (KR); Sang Kyun Kwon, Suwon-si (KR); Chang Hak Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 349 days.

(21) Appl. No.: 16/100,632

(22) Filed: Aug. 10, 2018

(65) Prior Publication Data

US 2019/0221351 A1 Jul. 18, 2019

(30) Foreign Application Priority Data

Jan. 17, 2018 (KR) ..... 10-2018-0006131

(51) Int. Cl.
*H01F 27/24* (2006.01)
*H01F 27/02* (2006.01)
(Continued)

(52) U.S. Cl.
CPC ..... *H01F 27/022* (2013.01); *H01F 1/15333* (2013.01); *H01F 3/08* (2013.01);
(Continued)

(58) Field of Classification Search
CPC ..... H01F 27/022; H01F 27/24; H01F 27/292; H01F 1/15333; H01F 17/04; H01F 27/32; H01F 27/255; H01F 3/10; H01F 3/08; H01F 27/324; H01F 2017/048; H01F 2003/106; H01F 1/01
See application file for complete search history.

(56) References Cited

U.S. PATENT DOCUMENTS 6,392,525 B1 * 5/2002 Kato ..... H01F 3/08 336/200
8,866,579 B2 * 10/2014 Hachiya ..... H01F 27/2804 336/200
(Continued)

FOREIGN PATENT DOCUMENTS

CN 102915825 A 2/2013
CN 103366919 A 10/2013
(Continued)

OTHER PUBLICATIONS

Office Action issued in corresponding Chinese Patent Application No. 201811311429.7 dated Nov. 4, 2020, with English translation.

*Primary Examiner* — Tuyen T Nguyen
(74) *Attorney, Agent, or Firm* — Morgan, Lewis & Bockius LLP

(57) ABSTRACT

An inductor includes a body including a coil and an encapsulant and an external electrode on an outer surface of the body. The encapsulant includes a first core surrounding the coil and a second core surrounding the first core. The first core includes a magnetic powder having high current characteristics, and the second core includes a magnetic powder having high capacity characteristics.

17 Claims, 2 Drawing Sheets

(51) Int. Cl.

| | |
|---|---|
| ***H01F 27/32*** | (2006.01) |
| ***H01F 27/255*** | (2006.01) |
| ***H01F 3/10*** | (2006.01) |
| ***H01F 3/08*** | (2006.01) |
| ***H01F 27/29*** | (2006.01) |
| ***H01F 1/153*** | (2006.01) |
| ***H01F 17/04*** | (2006.01) |

(52) U.S. Cl.
CPC ..... *H01F 3/10* (2013.01); *H01F 17/04* (2013.01); *H01F 27/24* (2013.01); *H01F 27/255* (2013.01); *H01F 27/292* (2013.01); *H01F 27/32* (2013.01); *H01F 27/324* (2013.01); *H01F 2003/106* (2013.01); *H01F 2017/048* (2013.01)

(56) References Cited

U.S. PATENT DOCUMENTS

| | | | | |
|---|---|---|---|---|
| 2007/0146109 | A1* | 6/2007 | Nogi ..... | H01F 3/14 336/200 |
| 2013/0033347 | A1 | 2/2013 | Matsuura et al. | |
| 2013/0127576 | A1 | 5/2013 | Hachiya et al. | |
| 2013/0249662 | A1 | 9/2013 | Tonoyama et al. | |
| 2016/0180995 | A1 | 6/2016 | Park et al. | |
| 2016/0254096 | A1 | 9/2016 | Adachi | |
| 2016/0276088 | A1 | 9/2016 | Kwon et al. | |
| 2017/0154713 | A1 | 6/2017 | Simon et al. | |
| 2017/0345552 | A1 | 11/2017 | Nakano et al. | |

FOREIGN PATENT DOCUMENTS

| | | | |
|---|---|---|---|
| CN | 105355409 | A | 2/2016 |
| CN | 105755368 | A | 7/2016 |
| CN | 105829263 | A | 8/2016 |
| CN | 105989990 | A | 10/2016 |
| CN | 106796835 | A | 5/2017 |
| CN | 107393671 | A | 11/2017 |
| CN | 107437458 | A | 12/2017 |
| JP | 2007-067214 | A | 3/2007 |
| KR | 10-1999-0066108 | A | 8/1999 |
| KR | 10-2016-0076840 | A | 7/2016 |

* cited by examiner

INDUCTOR

CROSS-REFERENCE TO RELATED APPLICATION(S)

This application claims the benefit of priority to Korean Patent Application No. 10-2018-0006131 filed on Jan. 17, 2018 in the Korean Intellectual Property Office, the disclosure of which is incorporated herein by reference in its entirety.

TECHNICAL FIELD

The present disclosure relates to an inductor, and more particularly, to a power inductor implementing high capacity.

BACKGROUND

A power inductor is an important passive device in electronic circuits, together with a resistor and a capacitor. Such a power inductor is used for components eliminating noise or making LC resonance circuits, or the like. The power inductor is mounted on an AP, a CP, a charger of a smartphone or a wearable device, and a PMIC of a display, or the like, and may serve as a power supply.

The conventional power inductor forms a body made of a magnetic body of a single composition, and allows a magnetic flux to flow around a coil to perform the power supply function. DC-bias, one characteristic of an inductor, has to be at least 2 A or more for a recently issued product to be slim, lightweight and compact, as well to have multifunctionality and a multi input multi output (MIMO) communications for a smartphone, and accordingly, to high inductance may be required to be implemented, even at high current. Thus, demand for inductors having excellent bias characteristics increases while maintaining a constant inductance value according to high current of a product.

SUMMARY

An aspect of the present disclosure is to provide an inductor having excellent DC-bias characteristics while maintaining a constant inductance value, according to high current of a product.

According to an aspect of the present disclosure, an inductor includes a body including a coil and an encapsulant, and having one surface and the other surface disposed perpendicularly to a core center of the coil and facing each other, and an external electrode on an external surface of the body. The encapsulant includes a first core directly surrounding the coil and a second core disposed on upper and lower surfaces of the first core. The first core includes a Fe-based nanocrystalline alloy represented by a compositional formula of $(Fe_{(1-a)}M^1{}_a)_{100-b-c-d-e-f-g}M^2{}_bB_cP_dCu_eM^3{}_g$, where, $M^1$ is at least one of cobalt (Co) and nickel (Ni), $M^2$ is at least one element selected from the group consisting of niobium (Nb), molybdenum (Mo), zirconium (Zr), tantalum (Ta), tungsten (W), hafnium (Hf), titanium (Ti), vanadium (V), chromium (Cr) and manganese (Mn), $M^3$ is at least one element selected from the group consisting of carbon (C), silicon (Si), aluminum (Al), gallium (Ga) and germanium (Ge), and a, b, c, d and e have a content condition of $0 \le a \le 0.5$, $2 \le b \le 3$, $9 \le c \le 11$, $1 \le d \le 2$, $0.6 \le e \le 1.5$ and $9 \le g \le 11$, respectively, based on an atomic %, and the second core includes a Fe-based alloy represented by a compositional formula of $(Fe_{(1-a)}M^1a)_{100-b-c-d-e-f-g}M^2{}_bB_cP_dCu_eM^3{}_g$, where, $M^1$ is at least one of Co and Ni, $M^2$ is at least one element selected from the group consisting of Nb, Mo, Zr, Ta, W, Hf, Ti, V, Cr and Mn, $M^3$ is at least two elements selected from the group consisting of C, Si, Al, Ga and Ge, C is an essential element, and a, b, c, d, andehave a content condition of $\le a \le 0.5$, $1.5 < b \le 3$, $10 \le c \le 13$, $0 < d \le 4$, $0 < e \le 1.5$ and $8.5 \le g \le 12$, respectively, based on an atomic %.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
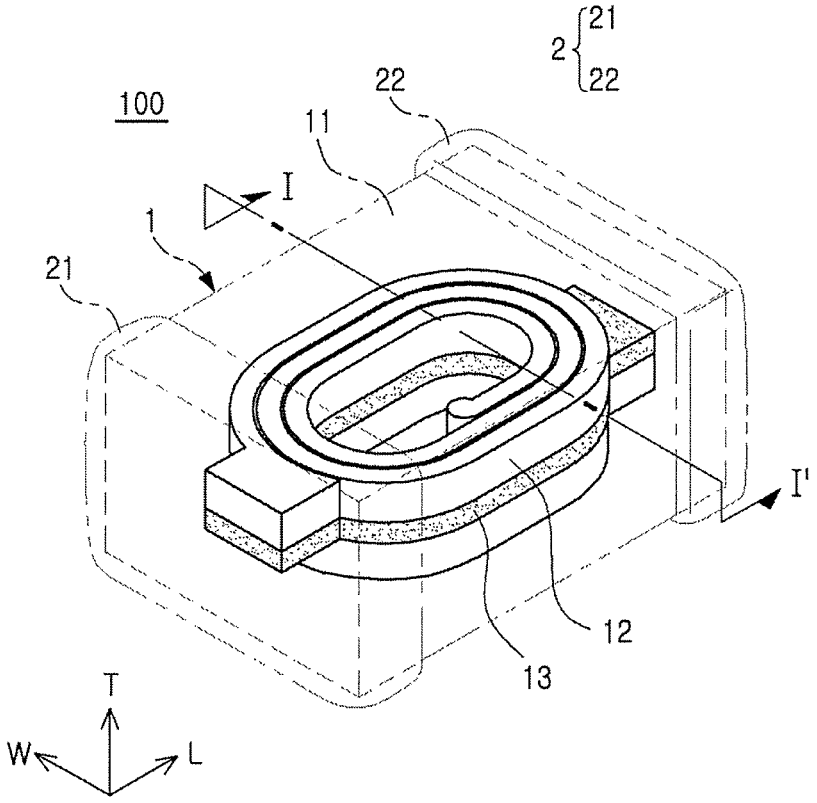
FIG. 1 is a schematic perspective view of an inductor according to an example of the present disclosure.

Hereinafter, exemplary embodiments in the present disclosure will be described with reference to the specific embodiments and the accompanying drawings. The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art. In the drawings, the shapes and dimensions of elements may be exaggerated for clarity, and the same reference numerals will be used throughout to designate the same or like elements.

Further, in the drawings, for increased clarity of the present disclosure, a portion of the drawing irrelevant to a corresponding description will be omitted, for the clear illustration of several layers and areas, views of enlarged portions thereof will be provided, and elements having the same functions within the same scope of the present disclosure will be designated by the same reference numerals.

Throughout the specification, when a component is referred to as "comprise" or "comprising," it means that it may include other components as well, rather than excluding other components, unless specifically stated otherwise.

Hereinafter, an inductor according to an example of the present disclosure will be described, but is not necessarily limited thereto.

Figure 2:
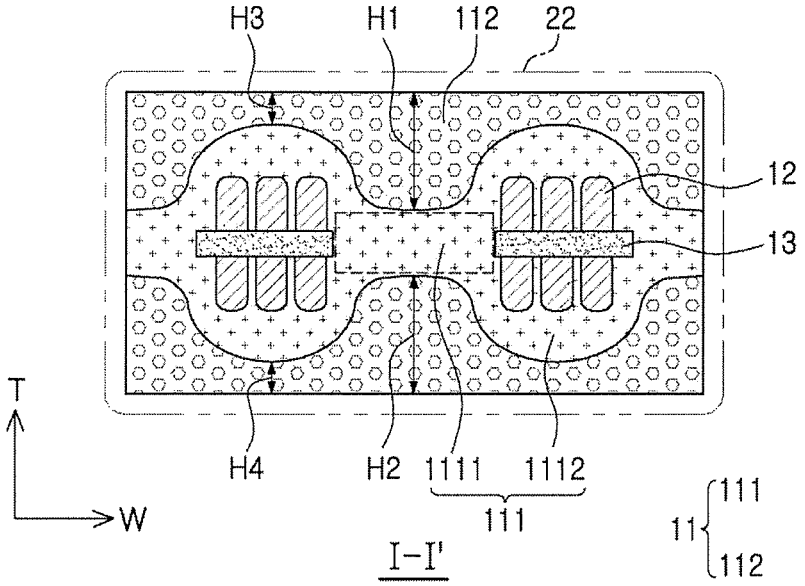
FIG. 2 is a cross-sectional view taken along line I-I' of FIG. 1.

FIG. 1 is a schematic perspective view of an inductor according to an example of the present disclosure and FIG. 2 is a cross-sectional view taken along line I-I' of FIG. 1.

Referring to FIGS. 1 and 2, an inductor 100 includes a body 1 including a coil 12 and an encapsulant 11 and an external electrode 2 disposed on an external surface of the body 1. The external electrode 2 includes a first external electrode 21 and a second external electrode 22, which are spaced apart from each other and function as having different polarities.

The body 1 forms an outer surface of the inductor 100, and includes an upper surface and a lower surface opposed in a thickness direction T, a first cross section and a second cross section opposed in a length direction L, and a first side surface and a second side surface opposed in a width direction W, to have substantially a hexahedral shape.

The first and second external electrodes 21 and 22 respectively disposed on the first and second cross sections of the body 1, and have a band portion extending to the upper surface, the lower surface and the first and second side surfaces adjacent thereto, but it is not limited thereto. For example, the lower electrode may be disposed on the lower surface only.

The body 1 includes an encapsulant 11 and a coil 12 encapsulated by the encapsulant 11.

First, the coil 12 has a plurality of coil patterns wound in a predetermined winding direction a plurality of times and has a spiral shape as a whole. The coil 12 may be a multilayer coil, a wire-wound coil, or a thin-film coil according to a manufacturing method, and may be appropriately selected by considering a manufacturing environment and a specification of a required inductor as required. In addition, the wire-wound coil may have an alpha winding, an edge wise winding, or the like, depending on a winding method, and the wires may be selected without limitation as required.

The coil 12 has to be made of a material having excellent electrical conductivity, and, for example, may include copper (Cu). Although not illustrated in detail, the coil 12 has a structure coated with an insulating layer (not shown) for insulation between an electroconductive material and a magnetic material of an encapsulant surrounding the coil 12. A material and a thickness of the insulating layer may be selected as required, and the insulating layer may be required to be formed thinly under a condition that insulating properties of the insulating layer is ensured, may be, for example, 1 μm or more and 10 μm or less. A method of forming the insulating layer has no limitation, when the coil 12 may be a thin-film coil, an insulating material may be formed on the surface of the coil 12 by chemical vapor deposition (CVD).

The coil 12 may be classified as a wire-wound coil winding a coil, a thin-film coil forming a coil by utilizing a method of plating, or the like, on at least one or more of upper and lower surfaces of a support member based on the support member, and a multilayer coil forming a coil by printing coil portions on a plurality of magnetic sheets, by using a bobbin, or the like, according to a forming method. For convenience of explanation, in the following description, the coil 12 corresponds to the thin-film coil. However, the wire-wound coil or the multilayer coil may be applied as required.

In addition, the coil 12 is insulated from the encapsulant 11 by being surrounded by an insulating layer (not illustrated), the insulating layer may be formed by any method without limitation, and any material having insulating properties may be included without limitation. In addition, a thickness of the insulating layer is sufficient to maintain only the insulating properties between the coil 12 and the encapsulant 11, and the case in which the thickness is unnecessarily great may not be required since the case does not contribute to the electrical characteristics of the inductor, such as the permeability, or the like.

The coil 12 may be supported by a support member 13, which the support member 13 is a configuration required to more easily form the coil 12 into a thin shape. In the case that the support member 13 having a thin-film type material including the insulating properties may be applied without any limitation, and for example, may be formed into a polypropylene glycol (PPG) substrate, a ferrite substrate or a metal-based soft magnetic substrate, or the like. In this case, a through-hole may be formed at a center of the support member 13, and a magnetic material, particularly a first core 111, is filled in the through-hole to form a core area. As described above, by forming the core area in the form filled with the magnetic material, the electrical characteristics such as the permeability, or the like of the inductor, may be improved.

Next, the encapsulant 11 includes a magnetic material having magnetic properties, and different materials each other, and each of the different materials is common in terms of an alloy, but is composed of different compositions and contents.

The encapsulant 11 is classified as a first core 111 and a second core 112.

The first core 111 is configured to surround the coil 12, the first core ill and the second core 112 are not mixed with each other, and the first core 111 is configured such that the second core 112 surrounds an outside of the first core 111 surrounding the coil 12.

Each of the first core 111 and the second core 112 is required to be symmetrical on a horizontal and a vertical basis with respect to the center of a core magnetic flux of the coil 12. Here, the core magnetic flux of the coil 12 corresponds to a center axis of the coil 12. In detail, horizontal symmetry means that each of the first and second cores 111 and 112 forms line symmetry, with respect to an imaginary line perpendicular to the center of the core magnetic flux when each of the first and second cores 111 and 112 is based on the center of the core magnetic flux of the coil 12. Further, vertical symmetry means that each of the first and second cores 111 and 112 has line symmetry, when each of the first and second cores 111 and 112 is based on the center of the core magnetic flux of the coil 12.

In this case, the thickness by which the first core 111 surrounds the coil 12 and the thickness of the second core 112 may be adjusted based on the body size of the same inductor, even in this case, to maintain the horizontal and vertical symmetry will be required. When the thickness of the first core 111 is relatively increased, high current characteristics of the inductor 100 are improved, and high capacity characteristics will be reduced due to the relatively reduced thickness of the second core 112. On the contrary, when the thickness of the second core 112 is relatively increased, while the high current characteristics of the inductor 100 are reduced, the high capacity characteristics of the inductor 100 will be relatively increased.

The first core 111 includes a Fe-based nanocrystalline alloy having relatively high current characteristics as compared with the second core, the Fe-based nanocrystalline alloy is represented by a compositional formula of $(Fe_{(1-a)}M^1{}_a)_{100-b-c-d-e-f-g}M^2{}_bB_cP_dCu_eM^3{}_g$, where, $M^1$ is at least one of Co and Ni, $M^2$ is at least one element selected from the group consisting of Nb, Mo, Zr, Ta, W, Hf, Ti, V, Cr and Mn, $M^3$ is at least one element selected from the group consisting C, Si, Al, Ga and Ge, and a b, c, d, e and g have a content condition of $0 \le a \le 0.5$, $2 \le b \le 3$, $9 \le c \le 11$, $1 \le d \le 2$, $0.6 \le e \le 1.5$ and $9 \le g \le 11$, respectively, based on an atomic %. A magnetization saturation Ms of the Fe-based nanocrystalline alloy included in the first core may 111 be 120 emu/g or more and 160 emu/g or less, and a coercive force Hc may be 20 A/m or less. Since the Fe-based nanocrystalline alloy included in the first core 111 entirely surrounds the coil 12, and is not mixed in a position in which the Fe-based nanocrystalline alloy included in the first core 111 is included, and therefore, Isat characteristics, a measure of DC-bias characteristics of the inductor 100 may be improved.

The Fe-based nanocrystalline alloy included in the first core 111 has an amorphous single-phase structure as a parent phase. Accordingly, in the case of a high-amorphous alloy, a size of the nanocrystalline may be effectively controlled by heat treatment. In the case in which the parent phase is made of only amorphous and does not include crystalline, the nanocrystalline having a fine structure may be easily obtained when heat treatment is performed.

The content of P in the Fe-based nanocrystalline alloy in the first core 111 has an advantageous range for improving amorphous characteristics. When the content of P is adjusted to 1-2 levels based on an atomic %, the amorphous characteristics of a parent phase is excellent such that the nanocrystalline having a fine structure may be obtained by heat treatment.

The first core 111 includes a first inner core 1111 disposed inside the innermost coil pattern of the coil 12 and a first outer core 1112 surrounding an upper surface of the coil 12, a lower surface of the coil 12, and the outermost coil pattern. The first inner core 1111 and the first outer core 1112 are integrally formed with each other, such that the boundaries may not be distinguished.

Since the first core 111 is symmetrical based on a core of the coil 12, the shortest distance H1 from an upper surface of the body 1 to the first inner core 1111 is the same as the shortest distance H2 to the first inner core 1112 from a lower surface of the body 1. Similarly, the shortest distance H3 from the upper surface of the body 1 to a first outer core 1112 is the same as the shortest distance H4 to the first outer core 1112 from the lower surface of the body 1.

In addition, since the first core 111 has a dumbbell-shaped sectional shape as a whole, the shortest distance H1 from the one surface of the body 1 to the first inner core 1111 is larger than the shortest distance H3 from the one surface of the body 1 to the first outer core 1112.

The second core 112 includes a Fe-based alloy having relatively high capacity characteristics as compared with the first core 111, and the Fe-based alloy is represented by a compositional formula of $Fe_{(1-a)}M^1{}_a)_{100-b-c-d-e-f-g}M^2{}_bB_cP_dCu_eM^3{}_g$, where, $M^1$ is at least one of Co and Ni, $M^2$ is at least one element selected from the group consisting Nb, Mo, Zr, Ta, W, Hf, Ti, V, Cr and Mn, $M^3$ is at least two elements selected from the group consisting C, Si, Al, Ga and Ge, and C is an essential element, and a, b, c, d, e, and g have a content condition of $0 \le a \le 0.5$, $1.5 < b \le 3$, $10 \le c \le 13$, $0 < d \le 4$, $0 < e \le 1.5$ and $8.5 \le g \le 12$, respectively, based on an atomic %. The Fe-based alloy included in the second core 112 may be a Fe-based nanocrystalline, an amorphous or a crystalline-based alloy, and preferably may be a Fe-based nanocrystalline alloy. The magnetic saturation Ms of the Fe-based alloy included in the second core 112 may be 160 emu/g or more, and a coercive force Hc may be 100 A/m or more. The content of Fe and C in the Fe-based alloy in the second core 112 is required that the content of C/(Fe content+C content) is excess 0.1 and less than 0.7 based on a weight ratio. When a numerical range is out of the range of excess 0.1 and less than 0.7, the capacity and efficiency may be lowered.

A magnetic saturation Ms of the Fe-based nanocrystalline alloy included in the second core 112 may be 160 emu/g or more, and a coercive force Hc of the Fe-based nanocrystalline alloy included in the second core 112 may be 100 A/m or less. Each of the magnetic saturation Ms and the coercive force Hc of the Fe-based nanocrystalline alloy included in the second core 112 has a value greater than the magnetic saturation and the coercive force of the Fe-based nanocrystalline alloy included in the first core 111.

Referring to Table 1 below, an inductor 100 according to an exemplary embodiment 1 having a 1608 size (1.6 mm×0.8 mm) and a thickness of 0.8 mm has different Ls and Isat characteristics, as compared with an inductor according to a comparative example 1 having a same chip size and a same coil structure. The inductors of the exemplary embodiment 1 and the comparative example 1 correspond to a R47 model represented by a winding type CIGW160808XMR47SLC. In this case, the same contents may be applied to the thin-film type as well as the winding type. The inductor 100 of the exemplary embodiment 1 is substantially the same as the inductor of the comparative example 1, including the second core 112 only in the body 1, except for differentiation of the first and second core coupling structures, by replacing the second core 112 in an area surrounding the coil 12 in the body 1 with the first body 111.

TABLE 1

| Sample | Ls [μH] | Isat [A] |
|---|---|---|
| Exemplary embodiment 1 | 0.48 | 4.1 |
| Comparative example 1* | 0.55 | 3.3 |
| comparison | −13% | +24% |

As can be seen from Table 1, an inductor 100 according to an exemplary embodiment 1 has a deteriorated Ls value, as compared with an inductor according to a comparative example 1. It is because the Fe-based nanocrystalline alloy of the second core 112 having high capacity in the inductor 100 according to the exemplary embodiment 1 is included in a relatively small amount as compared with the comparative example 1. However, since the inductor 100 according to the exemplary embodiment 1 corresponds to a R47 model, and then Ls reference value of 0.47 pH of the R47 model is satisfied, it cannot be determined that the Ls value of the inductor 100 of example embodiment 1 is deteriorated as compared with the value of the inductor of comparative example 1, may not indicate substantial deterioration in electrical characteristics.

In addition, the inductor 100 according to exemplary embodiment 1 shows that an Isat, a measure of the DC-bias characteristics, as compared with the comparative example 1 is significantly increased by from 3.3 A to 4.1 A. In the case of the conventional inductor, while the conventional inductor has trade-off characteristics in which the DC-bias characteristics are not high when the inductor has a high capacity, and the capacity is relatively low when the DC bias characteristic is high, since the inductor 100 according to exemplary embodiment satisfies Ls reference value and has high current characteristics, the inductor 100 according to the exemplary embodiment 1 is suitable for inductors that require both high capacity and high current characteristics.

Figure 3:
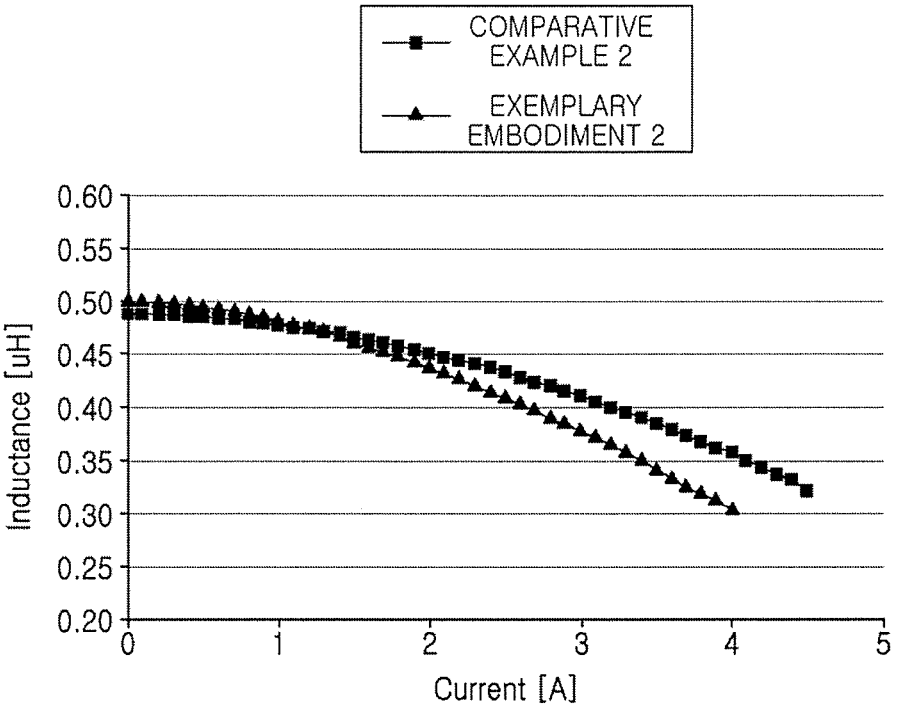
FIG. 3 is a graph comparing Isat of an inductor according to an example of the present disclosure with an inductor according to a comparative example.

On the other hand, FIG. 3 shows Ls-Isat characteristics, in the inductor 100 of an exemplary embodiment 2 and a comparative example 2. The exemplary embodiment 2 has an initial Ls value different from the value of the example embodiment 1, and the comparative example 2 has the initial Ls value different from the comparative example 1, only, but includes substantially the same chip size and coil structure.

FIG. 3 shows the Ls-Isat characteristics according to an applied current when the initial Ls value is equal to 0.5 μH. Referring to FIG. 3, the Isat of the comparative example 2 is 3.6 A, while the Isat of the exemplary embodiment 2 is 4.4 A. This indicates that the inductor 100 of the exemplary embodiment 2 includes excellent DC-bias characteristics, as compared with the inductor of the comparative example 2, and may replace the more inductors for smartphones.

The above-described inductor may provide an inductor that may simultaneously satisfy high capacitance and high current characteristics, thereby providing an inductor having excellent bias characteristics while maintaining an inductance value at a predetermined level or higher, even in a product requiring high current.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

Terms used herein are used only in order to describe an exemplary embodiment rather than limiting the present disclosure. In this case, singular forms include plural forms unless interpreted otherwise in context.

As set forth above, according to the exemplary embodiment in the present disclosure, an inductor has a high capacity and has excellent DC-bias characteristics.

While exemplary embodiments have been shown and described above, it will be apparent to those skilled in the art that modifications and variations could be made without departing from the scope of the present invention as defined by the appended claims.

What is claimed is:

1. An inductor comprising:

a body including a coil and an encapsulant, and having a first surface disposed perpendicularly to a center of a core of the coil and a second surface opposing the first surface; and an external electrode on an external surface of the body, wherein the encapsulant includes a first core surrounding the coil and a second core disposed on upper and lower surfaces of the first core, the first core includes a Fe-based nanocrystalline alloy represented by a compositional formula of $(Fe_{(1-a)}M^1{}_a)_{100-b-c-d-e-f-g}M^2{}_bB_cP_dCu_eM^3{}_g$, where, $M^1$ is at least one of cobalt (Co) and nickel (Ni), $M^2$ is at least one element selected from the group consisting of niobium (Nb), molybdenum (Mo), zirconium (Zr), tantalum (Ta), tungsten (W), hafnium (Hf), titanium (Ti), vanadium (V), chromium (Cr) and manganese (Mn), $M^3$ is at least one element selected from the group consisting of carbon (C), silicon (Si), aluminium (Al), gallium (Ga) and germanium (Ge), and a, b, c, d, e and g of the compositional formula have a content condition of $0 \le a \le 0.5$, $2 \le b \le 3$, $9 \le c \le 11$, $1 \le d \le 2$, $0.6 \le e \le 1.5$ and $9 \le g \le 11$, respectively, based on an atomic %, and the second core includes a Fe-based alloy represented by a compositional formula of $(Fe_{(1-a)}M^1{}_a)_{100-b-c-d-e-f-g}M^2{}_bB_cP_dCu_eM^3{}_g$, where, $M^1$ is at least one of Co and Ni, $M^2$ is at least one element selected from the group consisting of Nb, Mo, Zr, Ta, W, Hf, Ti, V, Cr and Mn, $M^3$ is at least two elements selected from a group consisting of C, Si, Al, Ga and Ge, C is an essential element, and a, b, c, d, e and g of the compositional formula have a content condition of $0 \le a \le 0.5$, $1.5 \le b \le 3$, $10 \le c \le 13$, $0 \le d \le 4$, $0 \le e \le 1.5$ and $8.5 \le g \le 12$, respectively, based on an atomic %.

2. The inductor according to claim 1, wherein in the Fe-based alloy of the second core, a ratio of C content as compared to Fe+C content, based on a weight ratio is over 0.1 and less than 0.7.

3. The inductor according to claim 1, wherein the first core includes a first inner core disposed inside the innermost coil pattern of the coil and a first outer core surrounding an upper surface of the coil, a lower surface of the coil, and the outermost coil pattern of the coil.

4. The inductor according to claim 3, wherein the shortest distance from the first surface of the body to the first inner core is substantially equal in length to the shortest distance from the second surface of the body to the first inner core.

5. The inductor according to claim 3, wherein the shortest distance from the first surface of the body to the first outer core is substantially equal in length to the shortest distance from the second surface of the body to the first outer core.

6. The inductor according to claim 3, wherein the shortest distance from the first surface of the body to the first inner core is larger than the shortest distance from the first surface of the body to the first outer core.

7. The inductor according to claim 1, wherein a magnetic saturation Ms of a magnetic powder included in the first core is smaller than a magnetic saturation Ms of a magnetic powder included in the second core.

8. The inductor according to claim 7, wherein the magnetic saturation Ms of the magnetic powder included in the first core is 120 emu/g or more and 160 emu/g or less, and the magnetic saturation Ms of the magnetic powder included in the second core is larger than 160 emu/g.

9. The inductor according to claim 1, wherein a coercive force Hc of a magnetic powder included in the first core is 20 A/m or less.

10. The inductor according to claim 1, wherein a coercive force Hc of a magnetic powder included in the second core is 100 A/m or more.

11. The inductor according to claim 1, wherein a parent phase of the Fe-based nanocrystalline alloy included in the first core has an amorphous single-phase structure.

12. The inductor according to claim 1, wherein the first core surrounds the coil in a dumbbell shape.

13. The inductor according to claim 1, wherein the first core is vertically symmetrical based on a core magnetic flux of the coil.

14. The inductor according to claim 1, wherein the first core is horizontally symmetrical based on a line perpendicular to a core magnetic flux of the coil.

15. The inductor according to claim 1, wherein the coil is insulated from an encapsulant, by being surrounded by an insulating layer.

16. The inductor according to claim 1, wherein the body further includes a support member, and the support member includes a through-hole disposed on a center thereof.

17. An inductor comprising:

a body including a coil and an encapsulant, and having a first surface disposed perpendicularly to a center of a core of the coil and a second surface opposing the first surface; and an external electrode on an external surface of the body, wherein the encapsulant includes a first core surrounding the coil and a second core disposed on upper and lower surfaces of the first core, the first and second cores each include a magnetic material, each magnetic material of the first and second cores including common materials in terms of an alloy, but being composed of different compositions and contents, and each of the first and second cores is symmetrical on a horizontal basis and a vertical basis with respect to the center of the core of the coil, and not mixed with each other, the first core includes a Fe-based nanocrystalline alloy represented by a compositional formula of $(Fe_{(1-a)}M^1{}_a)_{100-b-c-d-e-f-g}M^2{}_bB_cP_dCu_eM^3{}_g$, where, $M^1$ is at least one of cobalt (Co) and nickel (Ni), $M^2$ is at least one element selected from the group consisting of niobium (Nb), molybdenum (Mo), zirconium (Zr), tantalum (Ta), tungsten (W), hafnium (Hf), titanium (Ti), vanadium (V), chromium (Cr) and manganese (Mn), $M^3$ is at least one element selected from the group consisting of carbon (C), silicon (Si), aluminium (Al), gallium (Ga) and germanium (Ge), and a, b, c, d, e and g of the compositional formula have a content condition of $0 \le a \le 0.5$, $2 \le b \le 3$, $9 \le c \le 11$, $1 \le d \le 2$, $0.6 \le e \le 1.5$ and $9 \le g \le 11$, respectively, based on an atomic %, and the second core includes a Fe-based alloy represented by a compositional formula of $(Fe_{(1-a)}M^1{}_a)_{100-b-c-d-e-f-g}M^2{}_bB_cP_dCu_eM^3{}_g$, where, $M^1$ is at least one of Co and Ni, $M^2$ is at least one element selected from the group consisting of Nb, Mo, Zr, Ta, W, Hf, Ti, V, Cr and Mn, $M^3$ is at least two elements selected from a group consisting of C, Si, Al, Ga and Ge, C is an essential element, and a, b, c, d, e and g of the compositional formula have a content condition of $0 \le a \le 0.5$, $1.5 \le b \le 3$, $10 \le c \le 13$, $0 \le d \le 4$, $0 \le e \le 1.5$ and $8.5 \le g \le 12$, respectively, based on an atomic %.

* * * * *